US012778199B2

(12) United States Patent
Chen et al.

(10) Patent No.: US 12,778,199 B2
(45) Date of Patent: Nov. 3, 2026

(54) VAPORIZER AND ELECTRONIC VAPORIZATION DEVICE WITH PREHEATING MEMBER

(71) Applicant: Shenzhen Verdewell Technology Limited, Shenzhen (CN)

(72) Inventors: Shouhao Chen, Shenzhen (CN); Guoliang Ou, Shenzhen (CN)

(73) Assignee: Shenzhen Verdewell Technology Limited, Shenzhen (CN)

( * ) Notice: Subject to any disclaimer, the term of this patent is extended or adjusted under 35 U.S.C. 154(b) by 561 days.

(21) Appl. No.: 18/452,686

(22) Filed: Aug. 21, 2023

(65) Prior Publication Data

US 2024/0065326 A1 Feb. 29, 2024

(30) Foreign Application Priority Data

Aug. 30, 2022 (CN) ..... 202222309891.1

(51) Int. Cl.

| | |
|---|---|
| ***A24F 40/46*** | (2020.01) |
| ***A24F 40/10*** | (2020.01) |
| ***A24F 40/42*** | (2020.01) |
| ***A24F 40/48*** | (2020.01) |
| ***A24F 40/485*** | (2020.01) |

(52) U.S. Cl.

CPC ..... *A24F 40/46* (2020.01); *A24F 40/10* (2020.01); *A24F 40/42* (2020.01); *A24F 40/48* (2020.01); *A24F 40/485* (2020.01)

(58) Field of Classification Search

CPC ..... A24F 40/10

See application file for complete search history.

(56) References Cited

U.S. PATENT DOCUMENTS

| | | | | |
|---|---|---|---|---|
| 2021/0093018 | A1* | 4/2021 | Chen | A24F 40/00 |
| 2023/0062960 | A1* | 3/2023 | Zhou | A24F 40/48 |
| 2023/0240363 | A1* | 8/2023 | Huang | A24F 40/42 131/328 |

FOREIGN PATENT DOCUMENTS

| | | | | |
|---|---|---|---|---|
| CN | 214962605 U | | 12/2021 | |
| EP | 3981272 | A1 * | 4/2022 | A24F 40/46 |

OTHER PUBLICATIONS

Canadian Intellectual Property Office, Office Action in Canadian Patent Application No. 3,206,820 (Nov. 22, 2024).

* cited by examiner

*Primary Examiner* — Michael H. Wilson
*Assistant Examiner* — Michael Patrick Mullen
(74) *Attorney, Agent, or Firm* — Sughrue Mion, PLLC

(57) ABSTRACT

A vaporizer includes: a shell; a support arranged in the shell, a liquid storage cavity being defined between the support and the shell; a vaporization assembly arranged on the support for heating and vaporizing an aerosol-forming substrate; and a preheating member, the preheating member having a first end mounted to the support and thermally connected to the vaporization assembly and a second end extending into the liquid storage cavity.

12 Claims, 2 Drawing Sheets

VAPORIZER AND ELECTRONIC VAPORIZATION DEVICE WITH PREHEATING MEMBER

CROSS-REFERENCE TO PRIOR APPLICATION

Priority is claimed to Chinese Patent Application No. 202222309891.1, filed on Aug. 30, 2022, the entire disclosure of which is hereby incorporated by reference herein.

FIELD

The utility model relates to the technical field of vaporizers, and in particular, to a vaporizer and an electronic vaporization device.

BACKGROUND

An aerosol is a colloidal dispersion system formed by solid or liquid small particles dispersed and suspended in a gas medium. Since the aerosol may be absorbed by a human body through the respiratory system, a new alternative absorption way is provided for users. For example, a vaporization device that can produce aerosols by baking and heating aerosol-forming substrates of herbs or ointments is applicable to different fields, to deliver inhalable aerosols to the users, which replaces conventional product forms and absorption ways.

Generally, an aerosol-forming substrate is vaporized into aerosols through a vaporization assembly in an electronic vaporization device. However, due to the high viscosity of some aerosol-forming substrates, liquid feeding is slow during inhalation, and the vaporization assembly absorbs liquid slowly during heating, which may cause drying heating of the vaporization assembly during heating and vaporization. As a result, the first aerosol formed through vaporization produces a burnt taste, and the service life of the vaporization assembly is affected.

Therefore, in the related art, liquid feeding of some aerosol-forming substrates is unsmooth, which affects the vaporization performance.

SUMMARY

In an embodiment, the present invention provides a vaporizer, comprising: a shell; a support arranged in the shell, a liquid storage cavity being defined between the support and the shell; a vaporization assembly arranged on the support and configured to heat and vaporize an aerosol-forming substrate; and a preheating member, the preheating member having a first end mounted to the support and thermally connected to the vaporization assembly and a second end extending into the liquid storage cavity.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
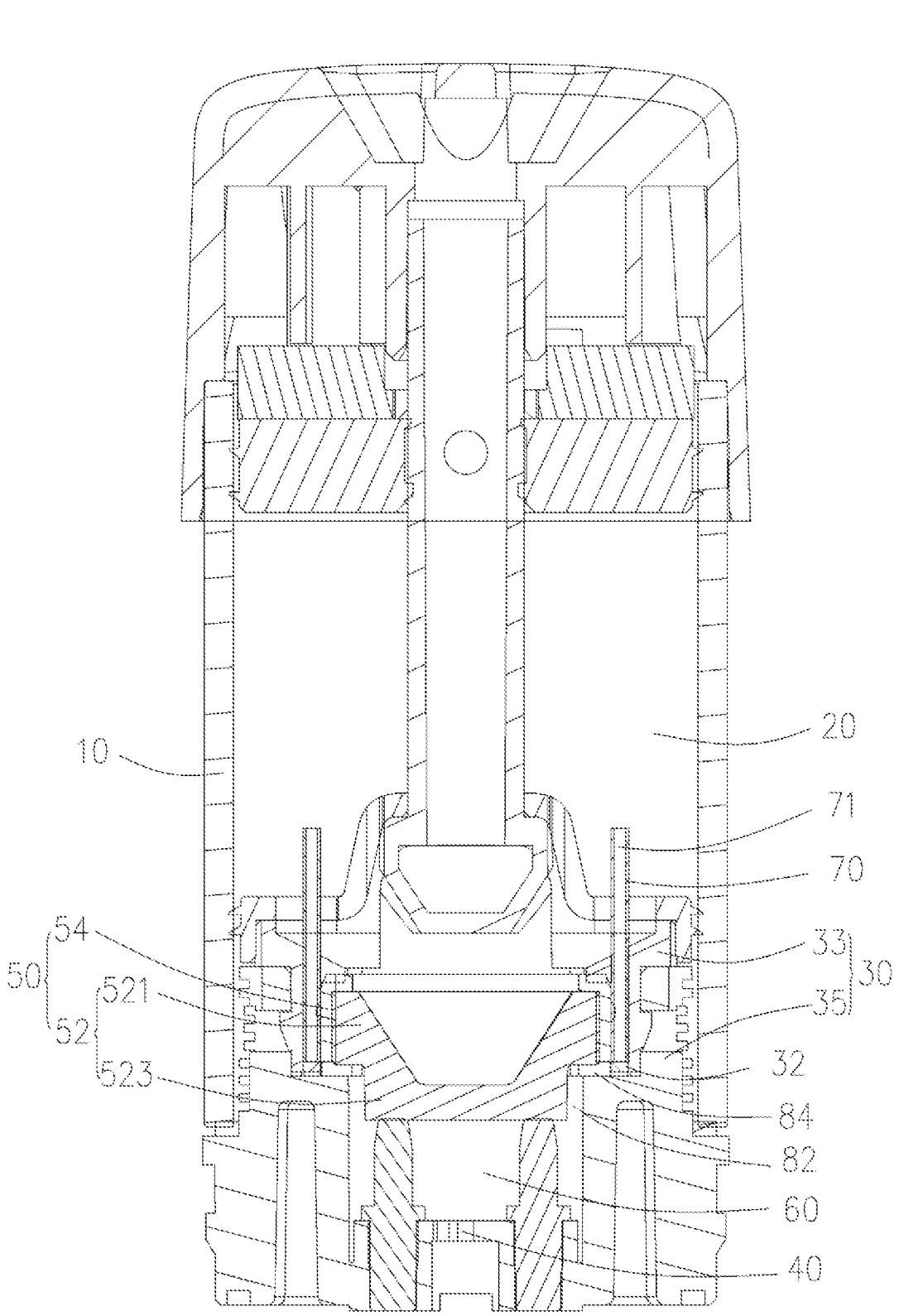
FIG. 1 is a schematic cross-sectional view of a vaporizer according to an embodiment of the utility model.

In an embodiment, the present invention provides a vaporizer and an electronic vaporization device to resolve the problem of unsmooth liquid feeding of an aerosol-forming substrate that may affect the vaporization performance.

In an embodiment, the present invention provides a vaporizer, including:

a shell;

a support, arranged in the shell, where a liquid storage cavity is defined between the support and the shell;

a vaporization assembly, arranged on the support and configured to heat and vaporize an aerosol-forming substrate; and a preheating member, having one end mounted to the support and thermally connected to the vaporization assembly and the other end extending into the liquid storage cavity.

In the above vaporizer, the preheating member is arranged on the support, and the preheating member is thermally connected to the vaporization assembly. When the vaporization assembly heats and vaporizes an aerosol-forming substrate, the heat generated by the vaporization assembly may be transmitted to the preheating member. The preheating member extends into the liquid storage cavity to preheat the aerosol-forming substrate in the liquid storage cavity, so as to reduce the viscosity of the aerosol-forming substrate and improve the liquid feeding smoothness of the aerosol-forming substrate. In this way, smooth liquid feeding of the aerosol-forming substrate with high viscosity can be realized, and the first aerosol formed through vaporization is prevented from producing a burnt taste, the service life of the vaporization assembly is prevented from being affected by drying heating, and the vaporization performance of the vaporization assembly is ensured.

In an embodiment, the end of the preheating member mounted to the support is in direct contact with the vaporization assembly.

In an embodiment, a mounting channel and a notch in communication with the mounting channel and facing the vaporization assembly are arranged on the support.

The preheating member is partially sleeved in the mounting channel and is in direct contact with the vaporization assembly through the notch.

In an embodiment, the preheating member is sleeved in the mounting channel through an interference fit.

In an embodiment, the vaporization assembly includes a vaporization member and a seal member, and the seal member is sleeved outside the vaporization member and is hermetically sleeved on the support.

The preheating member is in direct contact with the seal member.

In an embodiment, the preheating member is a metal member.

In an embodiment, a vent channel is arranged inside the preheating member, an air inlet channel is formed in the vaporizer, and the vent channel is in communication between the air inlet channel and the liquid storage cavity.

In an embodiment, the preheating member extends longitudinally in a first direction, and the vent channel penetrates the first direction.

In an embodiment, the air inlet channel is arranged on the support, a vaporization cavity in communication with the air inlet channel is defined between the vaporization assembly and the support, and the vent channel is in communication with the vaporization cavity.

In an embodiment, the vaporization assembly includes the vaporization member and the seal member, the vaporization member includes a mounting portion and a suspending portion, and the seal member is sleeved outside the mounting portion and is hermetically sleeved on the support.

The vaporization cavity is defined between a bottom surface of the suspending portion and the support, a first transition channel in communication with the vaporization cavity is defined between a side surface of the suspending portion and the support, a second transition channel in communication with the first transition channel is arranged on the seal member, and the second transition channel is in communication with the vent channel.

In an embodiment, the first transition channel extends in a direction parallel to the first direction, and the second transition channel extends in a direction intersecting the first direction.

In an embodiment, the support includes a first support and a second support, the vaporization assembly is assembled on the first support, the second support is mated with the first support, the air inlet channel is arranged on the second support, and the vaporization cavity is defined between the second support and the vaporization assembly.

The liquid storage cavity is defined between the first support and the shell, and the preheating member is assembled on the first support.

An electronic vaporization device is provided, including a battery assembly and the above vaporizer. The battery assembly is configured to supply power to the vaporizer.

Reference Numerals: 100. Vaporizer; 10. Shell; 20. Liquid storage cavity; 30. Support; 31. Mounting channel; 312. Notch; 32. Communication channel; 33: First support; 35: Second support; 40. Air inlet channel; 50. Vaporization assembly; 52. Vaporization member; 521. Mounting portion; 523. Suspending portion; 54. Seal member; 60. Vaporization cavity; 70. Preheating member; 71. Vent channel; 82. First transition channel; 84. Second transition channel.

In order to make the foregoing objective, features, and advantages of the utility model more clearly and easier to understand, specific embodiments of the utility model are described in details below with reference to drawings. In the following description, many specific details are described for thorough understanding of the utility model. However, the utility model may be implemented in many other manners different from those described herein. A person skilled in the art may make similar improvements without departing from the connotation of the utility model. Therefore, the utility model is not limited to the specific embodiments disclosed below.

In the description of the utility model, it should be understood that orientation or position relationships indicated by the terms such as "center", "longitudinal", "transverse", "length", "width", "thickness", "on", "below", "front", "back", "left", "right", "vertical", "horizontal", "top", "bottom", "inside", "outside", "clockwise", "anticlockwise", "axial direction", "radial direction", and "circumferential direction" are based on orientation or position relationships shown in the drawings, and are used only for ease and brevity of description of the utility model, rather than indicating or implying that the mentioned apparatus or element needs to have a particular orientation or be constructed and operated in a particular orientation. Therefore, such terms should not be construed as a limitation on the utility model.

Furthermore, the terms "first" and "second" are merely used for descriptive purpose, and should not be interpreted as indicating or implying relative significance or implicitly indicating a number of the indicated technical features. Therefore, the features defined with "first" and "second" may include at least one of the features explicitly or implicitly. In the description of the utility model, "a plurality of" means at least two, such as two or three, unless otherwise definitely and specifically defined.

In the utility model, unless otherwise explicitly specified or defined, the terms such as "mount", "connect", "connection", and "fix" should be understood in a broad sense. For example, the connection may be a fixed connection, a detachable connection, or an integral connection; or may be a mechanical connection or an electrical connection; or may be a direct connection, an indirect connection through an intermediate medium, internal communication between two elements, or an interaction relationship between two elements, unless otherwise definitely defined. A person of ordinary skill in the art can understand specific meanings of the terms in the utility model according to specific situations.

In the utility model, unless otherwise explicitly specified or defined, the first feature being located "above" or "below" the second feature may be the first feature being in a direct contact with the second feature, or the first feature being in an indirect contact with the second feature through an intermediary. Moreover, the first feature being "over", "above", and "on" the second feature may mean that the first feature is directly above or obliquely above the second feature, or merely means that the first feature has a larger horizontal height than the second feature. The first feature being "under", "below" and "underneath" the second feature may mean that the first feature is directly below or obliquely below the second feature, or merely means that the first feature has a smaller horizontal height than the second feature.

It should be noted that, when an element is referred to as "being fixed to" or "being arranged on" another element, the element may be directly located on the another element, or an intermediate element may exist. When an element is considered to be "connected to" another element, the element may be directly connected to the another element, or an intermediate element may exist. The terms "vertical", "horizontal", "upper", "lower", "left", "right", and similar expressions used herein are used for illustration but do not indicate a unique implementation.

Referring to FIG. 1, in an embodiment of the utility model, a vaporizer 100 is provided for heating and vaporizing an aerosol-forming substrate, to form aerosols for inhalation by a user.

The vaporizer 100 includes a shell 10, a support 30, a vaporization assembly 50, and a preheating member 70. The support 30 is arranged in the shell 10. A liquid storage cavity 20 is defined between the support 30 and the shell 10. The vaporization assembly 50 is arranged on the support 30 for heating and vaporizing an aerosol-forming substrate. One end of the preheating member 70 is mounted to the support 30 and thermally connected to the vaporization assembly 50, and the other end extends into the liquid storage cavity 20. The preheating member 70 is arranged on the support 30, and the preheating member 70 is thermally connected to the vaporization assembly 50. When the vaporization assembly 50 heats and vaporizes an aerosol-forming substrate, the heat generated by the vaporization assembly 50 may be transmitted to the preheating member 70. The preheating member 70 extends into the liquid storage cavity 20 to preheat the aerosol-forming substrate in the liquid storage cavity 20, so as to reduce the viscosity of the aerosol-forming substrate and improve the liquid feeding smoothness of the aerosol-forming substrate. In this way, smooth liquid feeding of the aerosol-forming substrate with high viscosity can be realized, and the first aerosol formed through vaporization is prevented from producing a burnt taste, the service life of the vaporization assembly 50 is prevented from being affected by drying heating, and the vaporization performance of the vaporization assembly 50 is ensured.

In some embodiments, one end of the preheating member 70 mounted to the support 30 is in direct contact with the vaporization assembly 50. The heat generated by the vaporization assembly 50 during heating and vaporization may be directly transmitted to the preheating member 70, so that the preheating member 70 conducts the heat into the liquid storage cavity 20, to preheat the aerosol-forming substrate in the liquid storage cavity 20.

Figure 2:
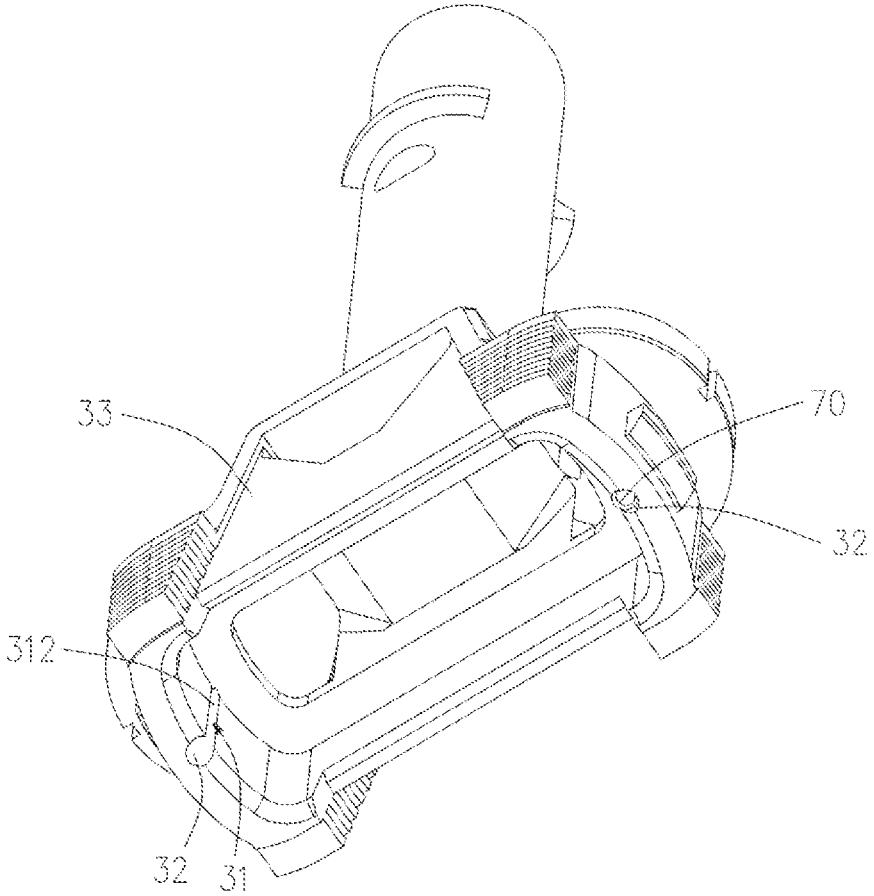
FIG. 2 is a schematic structural diagram of a first support of the vaporizer shown in FIG. 1.

Referring to FIG. 1 to FIG. 2, further, a mounting channel 31 and a notch 312 in communication with the mounting channel 31 and facing the vaporization assembly 50 are arranged on the support 30. The preheating member 70 is partially sleeved in the mounting channel 31 and is in direct contact with the vaporization assembly 50 through the notch 312. Therefore, by arranging the mounting channel 31 on the support 30 to mount the preheating member 70 and arranging the notch 312 in communication with the mounting channel 31 on the support 30, a part of the preheating member 70 is exposed from the notch 312, so that the preheating member 70 comes into direct contact with the vaporization assembly 50 after being exposed relative to the support 30, thereby allowing the heat on the vaporization assembly 50 to be efficiently transmitted to the preheating member 70.

Optionally, the notch 312 extends in an axial direction of the mounting channel 31 to ensure continuous contact between an elongated portion on an outer periphery of the preheating member 70 corresponding to the notch 312 and the vaporization assembly 50, thereby ensuring the thermal conductivity.

Specifically, the preheating member 70 is sleeved on the mounting channel 31 through an interference fit, to reliably fix and mount the preheating member 70 to the support 30.

In some embodiments, the preheating member 70 is a metal member, which has desirable thermal conductivity and can effectively conduct heat.

In some embodiments, the preheating member 70 extends longitudinally in a first direction to form the preheating member 70 with a longitudinal rod structure. One end of the preheating member may be mounted to the support 30, and the other end may extend into the liquid storage cavity 20. Optionally, the preheating member 70 is a circular rod with a diameter in a range of 0.6 mm to 2 mm. For example, the diameter of the preheating member 70 is 1 mm. Further, optionally, the preheating member 70 is a rod with other shapes, such as a polygonal rod, and a cross-sectional shape of the rod is not limited herein.

In some embodiments, a vent channel 71 is arranged inside the preheating member 70, an air inlet channel 40 is formed in the vaporizer 100, and the vent channel 71 is in communication between the air inlet channel 40 and the liquid storage cavity 20. Not only the preheating member 70 extends into the liquid storage cavity 20 to preheat the aerosol-forming substrate in the liquid storage cavity 20, but also the vent channel 71 in communication with the liquid storage cavity 20 and the air inlet channel 40 is formed on the preheating member 70. In this way, during the liquid feeding, external air can flow through the air inlet channel 40 to the vent channel 71 inside the preheating member 70, and finally enters the liquid storage cavity 20 to balance the air pressure in the liquid storage cavity 20 with the external atmospheric pressure, thereby preventing unsmooth liquid feeding caused by negative pressure generated in the liquid storage cavity 20 during the liquid feeding. In this way, the liquid feeding smoothness can be further ensured.

Further, the preheating member 70 extends longitudinally in a first direction, and the vent channel 71 penetrates the first direction. That is to say, the vent channel 71 is arranged in the extending direction of the preheating member 70 to communicate with the liquid storage cavity 20 and the air inlet channel 40 in the first direction in which the preheating member 70 extends, so as to introduce air into the liquid storage cavity 20, thereby maintaining a balanced pressure difference between inside and outside of the liquid storage cavity 20 during liquid feeding of the aerosol-forming substrate.

In some embodiments, the air inlet channel 40 is arranged on the support 30, a vaporization cavity 60 in communication with the air inlet channel 40 is defined between the vaporization assembly 50 and the support 30, and the vent channel 71 is in communication with the vaporization cavity 60. When the vaporization assembly 50 heats the aerosol-forming substrate, an aerosol may be formed in the vaporization cavity 60. After the external airflow enters the vaporization cavity 60 through the air inlet channel 40, the external airflow may carry the aerosol to the outside for inhalation by a user.

Moreover, by arranging the vent channel 71 to be in communication with the vaporization cavity 60, the vent channel can be indirectly communicated with the air inlet channel 40, so that the external airflow is allowed to enter the vent channel 71 and then flow to the liquid storage cavity 20, thereby maintaining a balanced pressure difference between the inside and outside of the liquid storage cavity 20.

Further, the vaporization assembly 50 includes a vaporization member 52 and a seal member 54, the vaporization member 52 includes a mounting portion 521 and a suspending portion 523, and the seal member 54 is sleeved outside the mounting portion 521 and is hermetically sleeved on the support 30. The vaporization cavity 60 is defined between a bottom surface of the suspending portion 523 and the support 30, a first transition channel 82 in communication with the vaporization cavity 60 is defined between a side surface of the suspending portion 523 and the support 30, a second transition channel 84 in communication with the first transition channel 82 is arranged on the seal member 54, and the second transition channel 84 is in communication with the vent channel 71.

In this way, the external airflow flows through the air inlet channel 40 and then flows to the vaporization cavity 60, and flows through the first transition channel 82 and the second transition channel 84 and then enters the vent channel 71, thereby realizing the ventilation function of the liquid storage cavity 20. Moreover, by arranging the second transition channel 84 on the seal member 54 to communicate the vaporization cavity 60 with the vent channel 71, communication between the vent channel 71 and the air inlet channel 40 is realized.

Specifically, the first transition channel 82 extends in a direction parallel to the first direction, and the second transition channel 84 extends in a direction intersecting the first direction. Since the first transition channel 82 intersects and is in communication with the second transition channel 84, the vaporization cavity 60 is transitionally communicated with the vent channel 71 extending in the first direction.

In some embodiments, the support 30 includes a first support 33 and a second support 35, the vaporization assembly 50 is assembled on the first support 33, the second support 35 is mated with the first support 33, the air inlet channel 40 is arranged on the second support 35, and the vaporization cavity 60 is defined between the second support 35 and the vaporization assembly 50. The liquid storage cavity 20 is defined between the first support 33 and the shell 10, and the preheating member 70 is assembled on the first support 33. The vaporization assembly 50 is mounted through the mating between the first support 33 and the second support 35, the preheating member 70 is assembled on the first support 33, and the preheating member 70 protrudes from the first support, so that the preheating member can extend into the liquid storage cavity 20 between the first support 33 and the shell 10, to preheat the aerosol-forming substrate.

In addition, the vaporization cavity 60 is defined between the second support 35 and the vaporization assembly 50, and the air inlet channel 40 is arranged on the second support 35, so that the external airflow can pass through the air inlet channel 40 on the second support 35 and then flow to the vaporization cavity 60 to carry the aerosol and flow to the user for inhalation.

Further, the mounting channel 31 and a communication channel 32 located on an axial end of the mounting channel 31 are arranged on the first support 33. The preheating member 70 is sleeved in the mounting channel 31, an opening of the vent channel 71 on the preheating member 70 faces the communication channel 32, and the communication channel 32 is in communication with the air inlet channel 40. Specifically, through the communication between the communication channel 32 and the second transition channel 84, the vent channel 71 is communicated with the air inlet channel 40.

Moreover, the seal member 54 includes an enclosure portion and a support portion. The enclosure portion surrounds an outer peripheral side of the mounting portion 521. The support portion is sleeved on a bottom of the mounting portion 521 and abuts against the second support 35. The second transition channel 84 is arranged on the support portion, thereby communicating the vaporization cavity 60 with the vent channel 71.

In an embodiment of the utility model, an electronic vaporization device is further provided, including a power supply assembly and a vaporizer 100 in any of the above embodiments. The power supply assembly is configured to supply power to the vaporizer 100, so that the vaporizer 100 heats and vaporizes an aerosol-forming substrate through the electrical energy provided by the power supply assembly.

The technical features in the foregoing embodiments may be randomly combined. For concise description, not all possible combinations of the technical features in the embodiments are described. However, provided that combinations of the technical features do not conflict with each other, the combinations of the technical features are considered as falling within the scope described in the description.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A vaporizer comprising:

a shell;

a support being arranged in the shell, a liquid storage cavity being defined between the support and the shell;

a vaporization assembly being arranged on the support and configured to heat and vaporize an aerosol-forming substrate;

a preheating member including a first end mounted to the support and thermally connected to the vaporization assembly, and a second end extending into the liquid storage cavity;

a vent channel being arranged inside the preheating member; and an air inlet channel being formed in the vaporizer, wherein the vent channel is in communication between the air inlet channel and the liquid storage cavity.

2. The vaporizer of claim 1, wherein the first end of the preheating member is in direct contact with the vaporization assembly.

3. The vaporizer of claim 2, wherein a mounting channel and a notch in communication with the mounting channel and facing the vaporization assembly are arranged on the support, and wherein the preheating member is partially sleeved in the mounting channel and is in direct contact with the vaporization assembly through the notch.

4. The vaporizer of claim 3, wherein the preheating member is sleeved in the mounting channel through an interference fit.

5. The vaporizer of claim 2, wherein the vaporization assembly comprises a vaporization member and a seal member, and the seal member is sleeved outside the vaporization member and hermetically sleeved on the support, and wherein the preheating member is in direct contact with the seal member.

6. The vaporizer of claim 1, wherein the preheating member comprises a metal member.

7. The vaporizer of claim 1, wherein the preheating member extends longitudinally in a first direction, and wherein the vent channel penetrates the first direction.

8. The vaporizer of claim 7, wherein the air inlet channel is arranged on the support, wherein a vaporization cavity in communication with the air inlet channel is defined between the vaporization assembly and the support, and wherein the vent channel is in communication with the vaporization cavity.

9. The vaporizer of claim 8, wherein the vaporization assembly comprises a vaporization member and a seal member, the vaporization member comprises a mounting portion and a suspending portion, and the seal member is sleeved outside the mounting portion and hermetically sleeved on the support, and wherein the vaporization cavity is defined between a bottom surface of the suspending portion and the support, a first transition channel in communication with the vaporization cavity is defined between a side surface of the suspending portion and the support, a second transition channel in communication with the first transition channel is arranged on the seal member, and the second transition channel is in communication with the vent channel.

10. The vaporizer of claim 9, wherein the first transition channel extends in a direction parallel to the first direction, and wherein the second transition channel extends in a direction intersecting the first direction.

11. The vaporizer of claim 8, wherein the support comprises a first support and a second support, the vaporization assembly is assembled on the first support, the second support is mated with the first support, the air inlet channel is arranged on the second support, and the vaporization cavity is defined between the second support and the vaporization assembly, and wherein the liquid storage cavity is defined between the first support and the shell, and the preheating member is assembled on the first support.

12. An electronic vaporization device comprising:

a battery assembly; and a vaporizer comprising a shell;

a support being arranged in the shell, a liquid storage cavity being defined between the support and the shell;

a vaporization assembly being arranged on the support and configured to heat and vaporize an aerosol-forming substrate;

a preheating member including a first end mounted to the support and thermally connected to the vaporization assembly, and a second end extending into the liquid storage cavity;

a vent channel being arranged inside the preheating member; and an air inlet channel being formed in the vaporizer, wherein the vent channel is in communication between the air inlet channel and the liquid storage cavity, wherein the battery assembly is configured to supply power to the vaporizer.

* * * * *